United States Patent [19]

Hedgewick

[11] 4,159,779

[45] Jul. 3, 1979

[54] SAFETY PACKAGE WITH THREADED STOP LOCK

[75] Inventor: Peter Hedgewick, Windsor, Canada

[73] Assignee: International Tools (1973) Limited, Windsor, Canada

[21] Appl. No.: 930,221

[22] Filed: Aug. 7, 1978

[51] Int. Cl.[2] ..... B65D 55/02; B65D 85/56; A61J 1/00

[52] U.S. Cl. ..... 215/214; 215/211

[58] Field of Search ..... 215/211, 214, 222, 223; 220/293, 295

[56] References Cited

U.S. PATENT DOCUMENTS

| | | | |
|---|---|---|---|
| 3,974,928 | 8/1976 | Domaracki et al. | 215/211 |
| 4,049,148 | 9/1977 | Suhr et al. | 215/214 |
| 4,053,078 | 10/1977 | Herr | 215/222 |
| 4,090,629 | 5/1978 | Hedgewick | 215/214 |

*Primary Examiner*—George T. Hall

*Attorney, Agent, or Firm*—Reising, Ethington, Barnard, Perry & Brooks

[57] ABSTRACT

A safety closure and container assembly including a container, cap and combined spring and sealing member. Retention nibs are formed on the inner surface of the skirt of the cap, and a spring and sealing member has a radially projecting flange that engages the retention nibs to prevent separation of the spring and sealing member from the cap. Cap and container locking elements are formed respectively on the inner surface of the skirt of the cap and the outer surface of the mouth of the container. The cap and container locking elements are engageable with and disengageable from each other by combined axial and rotary motion of the cap relative to the container. The spring and sealing member biases the cap and container locking elements toward locked engagement with each other when the cap is applied to the container. The cap and container locking elements are formed such that the sealing portion of the spring and sealing member is forced into the mouth of the container into sealing engagement therewith as the cap is rotated relative to the container so that the operator does not have to apply direct axial force to the cap in order to seal the container.

5 Claims, 5 Drawing Figures

SAFETY PACKAGE WITH THREADED STOP LOCK

TECHNICAL FIELD

This invention relates generally to safety closure and container assemblies, and is particularly concerned with an improvement in safety closure and container assemblies wherein it is necessary to provide a liquid or moisture proof seal for the contents of the container.

BACKGROUND ART

In order to reduce the number of accidental poisonings resulting from young children having access to unsafe medicines, drugs, household chemicals and other products, there has been considerable activity in recent years toward the development of closures and containers in which a type of manipulation between the cap and container is required in order to gain access to the contents of the container that a young child is incapable of performing. For example, it has been found that young children are generally incapable of manipulating a cap mounted on a container with bayonet-type locking means—a type of locking means that requires that the cap be pushed axially relative to the container and then rotated relative to the container in order to separate the cap from the container. The cap must be pushed axially toward the container against the biasing force of a spring in order to disengage the bayonet locking means. See, for example, Hedgewick U.S. Pat. No. Re. 27,156. Other examples of safety closure and container assemblies having various locking and sealing arrangements are disclosed in U.S. Pat. Nos. 2,776,066; 3,445,022; 3,608,763; 3,623,623; 3,669,294; 3,675,804; 3,739,933; 3,741,421; 3,888,376; 3,794,200; 3,952,899; 3,963,139; 3,979,001; 4,032,028; and 4,049,148.

When the contents of the container is liquid, or is some substance that deteriorates in an atmosphere of high humidity, the closure must be capable of maintaining an adequate seal under a variety of conditions. The contents of the container, if liquid, may require vigorous shaking before being used, or the contents may be of the type that causes a pressure buildup within the container over a period of time. A tight seal is also necessary in order to prevent the undesired escape of the contents from the container, and because the entrance of moisture and other contaminants into the container may cause deterioration of the contents.

In order to maintain a good seal against the entrance or escape of moisture, it is desirable to be able to provide a seal that projects into the mouth of the container and engages the inner surface of the container mouth with a tight fit. While the spring force on the cap should be sufficient to prevent children from gaining access to the contents, it should not be so great as to make unduly difficult for adults to manipulate the cap. Accordingly, a tight seal must be maintained by the closure without at the same time making it too difficult for adults to manipulate the closure.

In order to provide a tight, moisture proof seal, it is generally necessary for the cap to carry a sealing member with a flange that projects into the mouth of the container into tight, sealing engagement with the inner surface thereof. U.S. Pat. Nos. 3,432,065; 3,623,623; 3,753,510; 3,974,928; and 4,049,148 each disclose safety closure and container assemblies having sealing members that are pushed into the mouth of the container by dome-shaped spring portions on the sealing members.

Considerable force is required in order to insert and remove such sealing members from the mouth of the container. With conventional bayonet locking elements on the cap and container of the type shown in the patents referred to in the preceding paragraph, the seal is inserted into and removed from the container primarily by the application of direct axial force between the cap and container. The operator, in applying the cap to the container, must first exert considerable axial pressure between the cap and container in order to force the seal into the mouth of the container before the cap is rotated into locked engagement with the container. Conversely, in order to remove the cap from the container, after the cap has been unlocked from the container, the operator must pull the cap and seal axially from the container with a force sufficient to overcome the resistance of the seal to disengagement from the container. For the aged, arthritic or otherwise infirm user, the force required can cause considerable inconvenience.

DISCLOSURE OF THE INVENTION

An object of this invention is to provide a safety closure and container assembly wherein a moisture proof seal is provided by a sealing member that projects into the container mouth with cap and container locking means provided which will permit the cap to be applied to the container with a smooth, rotatable motion relative to the container to force the sealing member into tight engagement with the mouth of the container and wherein the locking means engage after the sealing member is pushed into the container such that the cap can be disengaged from the container only by first pushing the cap axially against a spring force on the sealing member and then rotating the cap relative to the container.

A further object is to provide a tight, moisture proof safety closure and container assembly having improved locking means that will permit the cap to be applied to the container with a smooth, rotatable motion requiring little strength on the part of the user.

In carrying out the foregoing, and other objects, a child resistant closure assembly according to the present invention includes a cap having an end wall with a skirt projecting therefrom with locking means formed on and projecting from the inner wall of the skirt for selective engagement with and disengagement from complementary locking means formed on the container. The cap locking means includes at least two sets of cap locking elements, each set being disposed in two helical paths on the inner surface of the skirt. Each of the cap locking elements includes an elongated thread-like rib having a trailing end located at the trailing end of the first helical path and a leading end located near the free end of the skirt. The cap locking elements further includes a pair of spaced locking lugs, the first one of which is located at the leading end of the second helical path and the second one of which is located between the first lug and the leading end of the thread-like rib. The container locking means includes at least two sets of container locking elements. Each set of container locking elements includes an elongated guide rib located along a first container helical path on the outer surface of the mouth portion of the container. Each set of container locking elements further includes a pair of spaced stop members located in the first container helical path. When the cap is applied to the container, the cap locking elements are cammed downwardly by the elongated guide rib until the leading locking lug engages a connector portion to cam the locking lugs into locked engagement with the stop members. The elongated thread-like member of the cap locking elements engages the underside of the guide rib on the container to prevent axial separation of the cap and container, the engagement of the locking lugs and stop members preventing rotary motion of the cap relative to the container. To remove the cap, the cap is pushed axially toward the container to disengage the locking lugs from the stop members to permit reverse rotation of the cap relative to the container.

Other objects, advantages and features of the invention will become apparent from the following description taken in connection with the accompanying drawings.

BEST MODE FOR CARRYING OUT THE INVENTION

Figure 1:
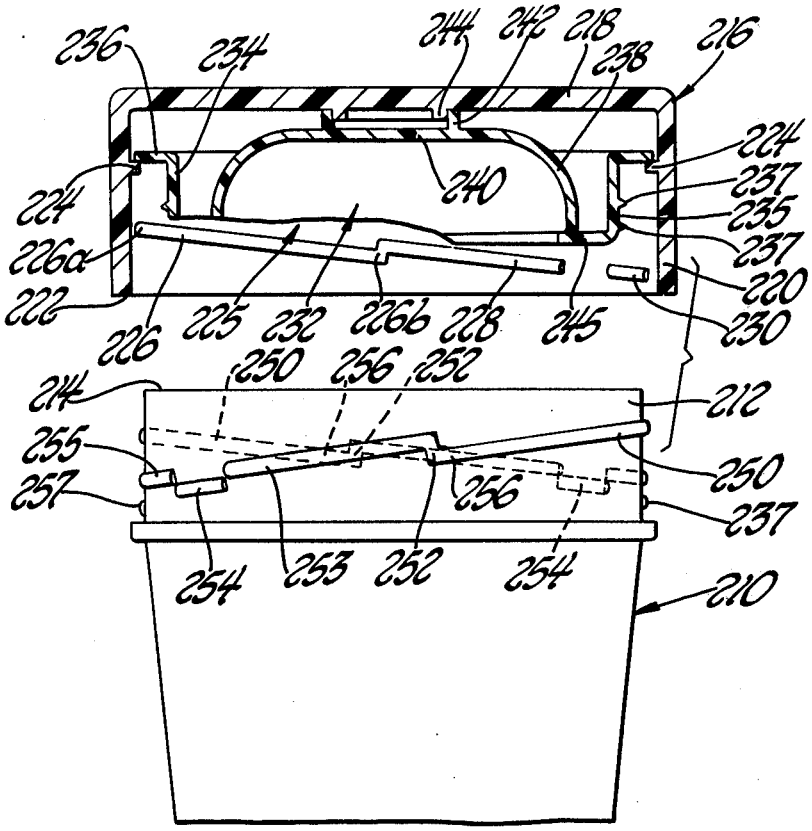
FIG. 1 is a sectional view of a safety closure assembly embodying the invention, the closure assembly being removed from the container.

With reference to the drawings, a safety closure and container assembly according to the embodiment of FIGS. 1–5 includes a container designated generally by reference numeral 210 and having a neck or mouth portion 212 with an annular rim 214.

The safety closure assembly of FIGS. 1–5 includes a cap 216 made of molded plastic material and having an end wall 218 with a peripheral skirt 220 projecting axially therefrom for receiving the mouth portion 212 of the container 210. The skirt 220 has a free end 222 opposite the end wall 218 of the cap 216.

Figure 2:
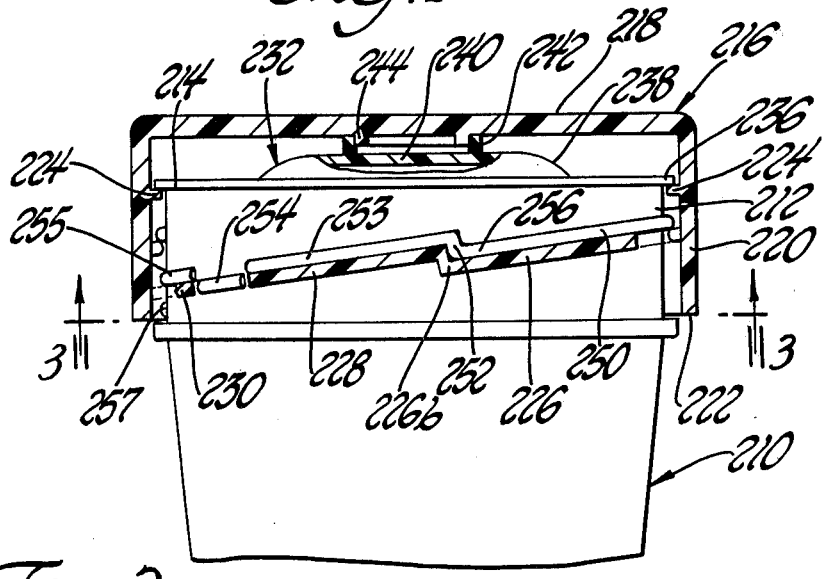
FIG. 2 is a view similar to FIG. 1 with the closure assembly of FIG. 1 applied to the container.

When the cap 216 is mounted on the container 210 in the closed and locked position shown in FIG. 2, it is biased against movement from locked engagement with the container 210 by a one piece plastic spring and sealing member designated collectively by reference numeral 225.

The inner surface of the skirt 220 of the cap is formed with retention means for the sealing memer 225, as well as cap locking means. The retention means is in the form of a plurality of retention nibs 224 projecting inwardly from the skirt 220. The sealing member 225 engages the retention nibs 224 to prevent axial separation of the spring and sealing member 225 from the cap 216.

The cap locking means includes at least two sets of cap locking elements. Each set of cap locking elements is disposed in two helical paths on the inner surface of the skirt 220. Each set of cap locking elements includes an elongated rib 226 having a trailing end **226*a* and a leading end 226*b* (FIG. 1). The trailing end 226*a* is located axially between the retention nibs 224 and the leading end 226*b*. The trailing end 226*a* of each rib 226 defines the trailing end of the first helical path of each set of locking elements on the cap 216. The cap locking elements also include a pair of spaced locking lugs 228 and 230, the locking lug 230 being located at the leading end of the second helical path. The locking lug 228 is located between the locking lug 230 and the leading end 226*b* of the rib 226 and is integrally formed with the rib 226 at the leading end 226*b*. The locking lug 228 and the rib 226** together define a z-thread or rib.

Figure 3:
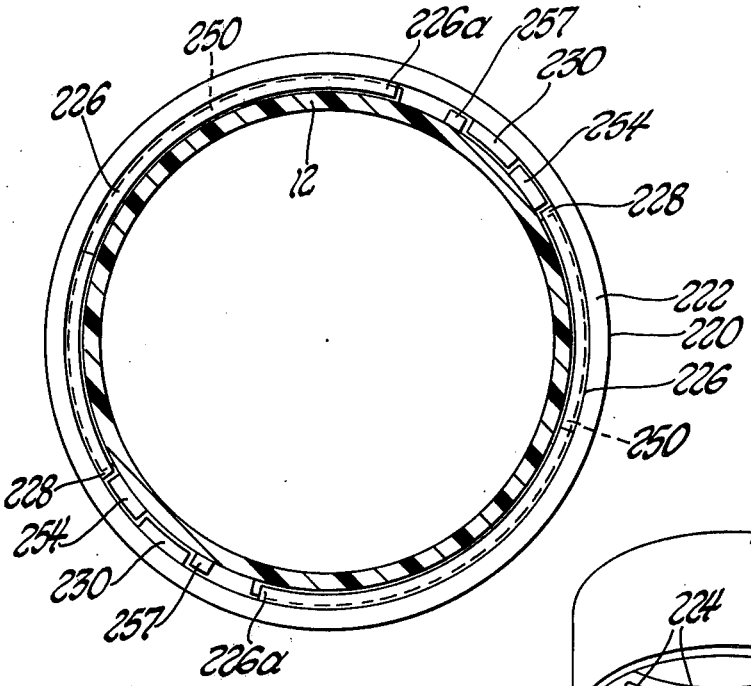
FIG. 3 is a sectional view taken on lines 3—3 of FIG. 2.
Figure 4:
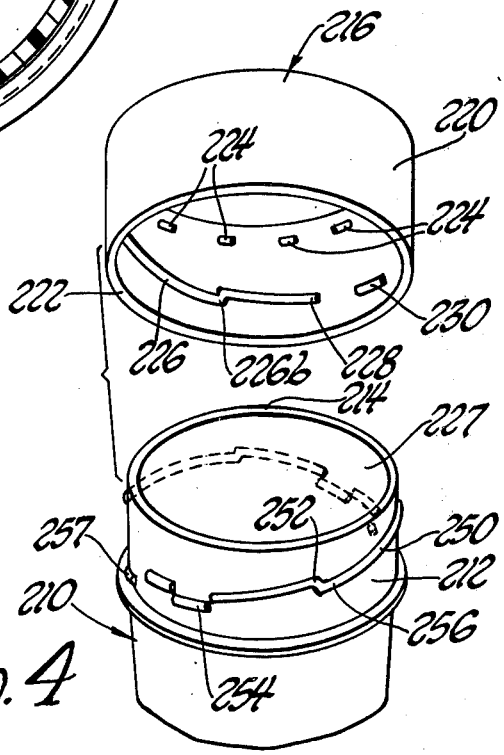
FIG. 4 is an exploded perspective view of the cap and container with the spring and sealing member omitted.

The spring and sealing member 225 comprises a one piece molded plastic body having an annular sealing portion which, when the closure assembly is applied to the container 210 as illustrated in FIG. 3, engages the rim 214 and the inner surface 227 of the mouth portion of the container 210.

The sealing portion of the member 225 includes a cylindrical sealing wall 234 having an outer surface 235 for engaging the inner surface of the mouth of the container 210, and a flange 236 projecting radially outwardly from the upper or outer end of the sealing wall 234 for overlying the container rim 214. In the illustrated embodiment, a pair of axially spaced ribs 237 are formed on the surface 235 of the sealing wall 234.

The spring and sealing member 225 includes a dome-shaped plunger portion 232 having a cylindrical base portion 242 which is concentric with the sealing wall 235. The base portion 242 engages the inner surface of the end wall 218 of the cap 216. In the illustrated embodiment, a cylindrical projection 244 is formed on the inner surface of the end wall 218 of the cap 216 for cooperating with the base portion 242 to maintain the spring member 225 centered with respect to the cap 216.

The base portion 242 is formed with a closure portion 240 at the inner end of the cylindrical wall of the base portion 242. Extending between the lower end of the base portion 242 and the inner end of the sealing wall 234 opposite flange 236 is a side wall 238. The side wall 238 is of annular cross-section, and flares downwardly and outwardly in a bell-shaped configuration from the periphery of the lower end of the base portion 242 to a flange portion 245 which integrally connects the side wall 238 to the periphery of the lower, inner end of the sealing wall 234. When the sealing member 225 is installed in the cap 216, it is pressed toward the end wall 218 until flange 236 snaps over the retention nibs 224 as shown in FIG. 1.

The outer surface of the mouth portion 212 of the container 210 is formed with container locking means. The container locking means includes at least two sets of container locking elements. Each set of container locking elements includes an elongated helical guide rib 250, and a pair of spaced stop members 252 and 254 located at the leading end of the guide rib 250. The stop members 252 and 254 are located in the first helical path on the container 210. Offset above the helical path of the guide rib 250 are a pair of spaced vertical stop members 253 and 255. The stop members 253 and 255 are located at the leading end of the guide rib 250 and in a second helical path on the container 210. The stop member 253 is integrally formed with the stop member 252. Each set of container locking elements also includes a stop means or a check member 257 also located at the leading end of the guide rib 250. The check member 257 is located in a third helical path of the container 210 offset below the helical path of the guide rib 250. A connector portion 256 also disposed in the first helical path integrally connects the leading end of the guide rib 250 with the stop member 252.

Figure 5:
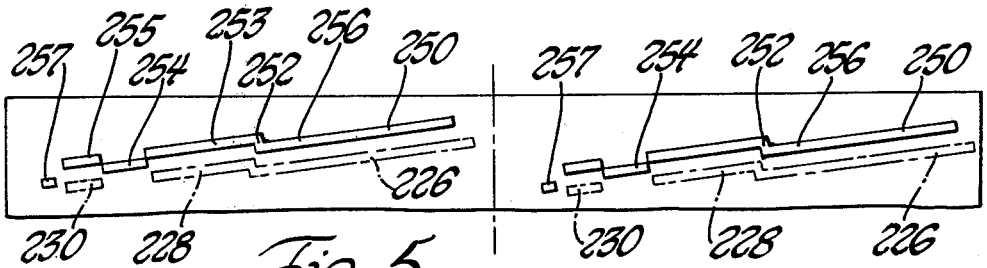
FIG. 5 is a developed view of the outer surface of the container mouth portion with the cap locking means illustrated in phantom lines.

When the cap 216 is placed on the container 210, the mouth portion 212 is received in the skirt 220 of the cap 216. As the cap 216 is rotated, the locking lugs 228 and 230 each engage one of the guide ribs 250 beginning at the trailing end thereof opposite the connector portion 256. As the cap 216 is rotated, the guide ribs 250 cause the locking lugs 228 and 230 to pull the cap 216 axially toward the container 210 and simultaneously force the sealing member 225 into the mouth portion 212 of the container 210 so that the surface 235 and ribs 237 engage the mouth portion 212 of the container 210 with a tight fit. When the locking lug 230 reaches the connector portion 256, the sealing member 225 is in tight, sealing relationship with the container 210 with the ribs 237 and the sealing wall surface 235 in tight sealing engagement with the inner surface of the container mouth portion 212. As the lugs 230 and 228 are moved passed the connector portion 256, (the position illustrated in FIG. 5), the sealing member is flexed downwardly because of the reaction between the flange 236 and rim 214 of the container 210. When the locking lugs 228 and 230 reach the position illustrated in FIG. 5, further movement of the lugs 230 and 228 is stopped by the check member 257 which engages the lug 230 if the cap 216 is further rotated. As shown in FIG. 5, the stop member 254 is located between lugs 228 and 230, and lug 228 is located between the stop members 252 and 254, the spring portion of the member 225 urges the lugs 228 and 230 into the locked position illustrated in FIG. 2. As shown in FIG. 2, the locking lugs 228 and 230 engage the stop members 253 and 255 to prevent the cap 216 from cocking or tilting on the container 210 when locked.

The engagement of the locking lugs 228 and 230 with the stop members 252 and 254 prevents rotation of the cap 216 relative to the container 210. The engagement of ribs 226 with the guide ribs 250 and the engagement of the lugs 228 and 230 with the stop members 253 and 255, respectively, as shown in FIG. 2 prevents axial separation of the cap 216 from the container 210.

In order to remove the cap 216 from the container 210, it is necessary to press the cap 216 toward the container 210 against the biasing force of member 225 to disengage lugs 228 and 230 from the stop members 252 and 254 and the stop members 253 and 255 as illustrated in FIG. 5. Reverse rotation of the cap 216 then permits the cap 216 to be axially withdrawn from the container 210. The engagement of the flange 236 with the retention nibs 224 causes the spring and sealing member 225 to separate from the container 210 with the cap 216.

If it is desired not to lock the cap 216 to the container 210 as shown in FIG. 2, rotation of the cap 216 relative to the container 210 can stop when the lugs 230 engage the respective connector portions 256. In this position, the spring and sealing member 225 will be in sealing engagement with the mouth portion 212 of the container 210, and it will not be necessary to press the cap 216 axially toward the container 210 before removing it.

While specific forms of the invention are illustrated in the accompanying drawings and described in the foregoing specification, it should be understood that the invention is not limited to the exact construction shown. To the contrary, alterations in the construction and arrangement of parts, all falling within the scope and spirit of the invention, will be apparent to those skilled in the art.

What is claimed is:

1. A safety closure assembly comprising: a cap having an end wall with a skirt projecting axially from the periphery thereof and having a free end spaced axially from said end wall with cap locking means formed on the inner surface of the skirt adapted to be engaged with and disengaged from complementary container locking means on a container by combined axial and rotary motion of the cap relative to the container; a spring and sealing member for sealingly engaging a container to which the cap is adapted to be applied and at the same time biasing the cap locking means into locked engagement with the container locking means, said spring and sealing member including an axially extending sealing surface adapted to be received in the mouth of the container for sealing engagement with the inner surface thereof; retention means on the cap for preventing axial separation of said spring and sealing member from said cap; said cap locking means including at least two sets of cap locking elements, each set of cap locking elements being disposed in two helical paths on the inner surface of said skirt and extending from a trailing end to a leading end in the direction from said end wall to the free end of said skirt, each set of cap locking elements including an elongated thread-like rib having a trailing end located at the trailing end of said first helical path and a leading end; said cap locking elements further including a pair of spaced locking lugs located in the second helical path; offset from said first helical path on the side of said first helical path opposite the free end of the skirt, the second lug being located between said first lug and the leading end of said thread-like rib and spaced from said first lug.

2. A safety closure assembly as claimed in claim 1 wherein said retention means comprises a plurality of retention nibs projecting from the inner surface of said skirt and located between said cap locking means and the end wall of said cap, and wherein said spring and sealing member includes a radially projecting flange that engages the retention nibs on the side thereof opposite the cap locking means to prevent separation of the spring and sealing member from said cap.

3. A safety closure and container assembly comprising: a container having a mouth portion with an annular rim and container locking means formed on the outer surface of said mouth portion; a cap having an end wall with a skirt projecting axially from the periphery thereof and having a free end spaced axially from said end wall with cap locking means formed on the inner surface of said skirt; said cap locking means being engageable with and disengageable from said container locking means in bayonet fashion by combined axial and rotary motion of the cap relative to the container; a combined spring and sealing member for sealingly engaging the inner surface of the container mouth and at the same time biasing the cap locking means against disengagement from the container locking means; retention means formed on said cap for preventing axial separation of said spring and sealing member from said cap when the cap is removed from the container; said container locking means including at least two sets of container locking elements, each set of container locking elements including an elongated guide rib located along a helical path on the outer surface of the mouth portion of said container with a trailing end located at the trailing end of said helical path and a leading end located at the leading end of said helical path with the trailing end located axially between said leading end and the end wall of said cap; each set of container locking elements further including a pair of spaced stop members located in the helical path on the outer surface of said mouth portion, both of said stop members being located in advance of the leading end of said guide rib and including first and second spaced stop members with the second stop member circumferentially located between the first stop member and the leading end of said guide rib, each set of container locking elements further including a connector portion connecting said second stop member with the leading end of said guide rib; said cap locking means including at least two sets of cap locking elements, each set of cap locking elements being disposed in a first helical path on the inner surface of said skirt and extending from a trailing end to a leading edge in the direction from the end wall of said cap to the free end of said skirt, each set of said cap locking elements including an elongated thread-like rib having a trailing end located at the trailing end of said last named helical path and a leading end; said cap locking elements further including a pair of spaced locking lugs, the first and second locking lugs being located in a second helical path on the inner surface on said skirt offset from said first helical path on the side of said first helical path opposite the free end of the skirt, the second lug being located between said first lug and the leading end of said thread-like rib and spaced from said first lug; each of said first locking lugs being engageable with the trailing end of one of said guide ribs as the cap is applied to the container for forcing the cap axially toward the container and the sealing member axially into the mouth of the container as the cap is rotated relative to the container until said first lugs each engage a respective one of the connector portions, said connector portions causing the spring and sealing member to flex as the lugs move past the connector portion until said first stop member is located between said lugs where upon the biasing force of said spring and sealing member urges the locking lugs into locked engagement with said stop member to prevent rotation of the cap relative to the container.

4. The safety closure and container assembly as claimed in claim 3 wherein each set of container locking elements further includes a second pair of spaced stop members located in a second helical path on the outer surface of said mouth portion offset from said first helical path between said first helical path and the container rim, said second pair of stop members engaging said locking lugs in the locked position to prevent the cap from cocking relative to the container.

5. The safety closure and container assembly as claimed in claim 3 or claim 4 further comprising a check member located on the outer surface of said mouth portion offset from said first and second helical paths on the mouth portion for engaging said first lug to limit said relative rotation.

* * * * *